US008678300B2

(12) United States Patent
Hornby

(10) Patent No.: US 8,678,300 B2
(45) Date of Patent: Mar. 25, 2014

(54) AUTOMOTIVE DIESEL EXHAUST WATER COOLED HC DOSING

(75) Inventor: Michael J. Hornby, Williamsburg, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1191 days.

(21) Appl. No.: 11/802,209

(22) Filed: May 21, 2007

(65) Prior Publication Data

US 2007/0290070 A1 Dec. 20, 2007

Related U.S. Application Data

(60) Provisional application No. 60/805,129, filed on Jun. 19, 2006.

(51) Int. Cl.
*B05B 1/24* (2006.01)
*B05B 15/00* (2006.01)

(52) U.S. Cl.
USPC ..... 239/132.3; 239/128; 239/132; 239/132.1

(58) Field of Classification Search
USPC ..... 239/128, 129, 132, 132.3, 398, 418, 239/132.1; 60/274, 282, 286, 295, 299, 60/301, 302, 303; 55/DIG. 10, DIG. 30
See application file for complete search history.

(56) References Cited

U.S. PATENT DOCUMENTS

| | | | | |
|---|---|---|---|---|
| 1,919,904 | A * | 7/1933 | Pielstick | 239/132.3 |
| 5,709,080 | A * | 1/1998 | Arora et al. | 60/274 |
| 6,539,708 | B1 * | 4/2003 | Hofmann et al. | 60/286 |
| 6,814,303 | B2 * | 11/2004 | Edgar et al. | 239/128 |
| 7,168,241 | B2 * | 1/2007 | Rudelt et al. | 60/286 |
| 2007/0158466 | A1 * | 7/2007 | Harmon et al. | 239/398 |

* cited by examiner

*Primary Examiner* — Ryan Reis

(57) ABSTRACT

Dosing structure (30) is provided for supplying diesel fuel to an exhaust passage (12) of a diesel system. The dosing structure includes an electrically operated dosing valve (32) constructed and arranged to receive a supply of diesel fuel and to deliver the fuel to the exhaust passage. A water jacket (34) surrounds at least a portion of the dosing valve so as to provide direct water-cooling of the dosing valve. The dosing valve is preferably an electrically controlled fuel injector.

20 Claims, 5 Drawing Sheets

AUTOMOTIVE DIESEL EXHAUST WATER COOLED HC DOSING

This application claims the benefit of the earlier filing date of U.S. Provisional Application. No. 60/805,129, filed on Jun. 19, 2006, which is incorporated by reference herein in its entirety.

FIELD OF THE INVENTION

This invention relates to reducing and trapping diesel particulates of a diesel engine for vehicles.

BACKGROUND OF THE INVENTION

Federal and state governments have imposed increasingly strict regulations over the years governing the levels of hydrocarbon (HC), carbon monoxide (CO) and nitrogen oxide (NOx) pollutants that a motor vehicle may emit to the atmosphere.

In diesel engine systems, a diesel particulate filter (DPF) is provided to trap the particulate matter in the exhaust passage of the diesel engine. Conventionally, a dosing valve is mounted into the exhaust passage of a diesel system to inject diesel fuel into the exhaust stream to reduce the particulate matter and thus reduce NOx emissions. Since the temperature of the exhaust passage near the manifold can reach 600 C, cooling is desired to ensure that the valve survives.

Thus, there is a need to provide a cost-effective, exhaust dosing valve that can be cooled.

SUMMARY OF THE INVENTION

An object of the invention is to fulfill the need referred to above. In accordance with the principles of the present invention, this objective is achieved by providing dosing structure for supplying diesel fuel to an exhaust passage of a diesel system. The dosing structure includes an electrically operated dosing valve constructed and arranged to receive a supply of diesel fuel and to deliver the fuel to the exhaust passage. A water jacket surrounds at least a portion of the dosing valve so as to provide direct water-cooling of the dosing valve. The dosing valve is preferably an electrically controlled fuel injector.

In accordance with another aspect of the invention, a method of supplying diesel fuel to an exhaust passage of a diesel system to reduce particulates in the exhaust passage provides an electrically controlled fuel injector as a dosing valve associated with an exhaust passage of a diesel system. The dosing valve is operated to inject diesel fuel into the exhaust passage. Water cooling is provided to cool the dosing valve.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
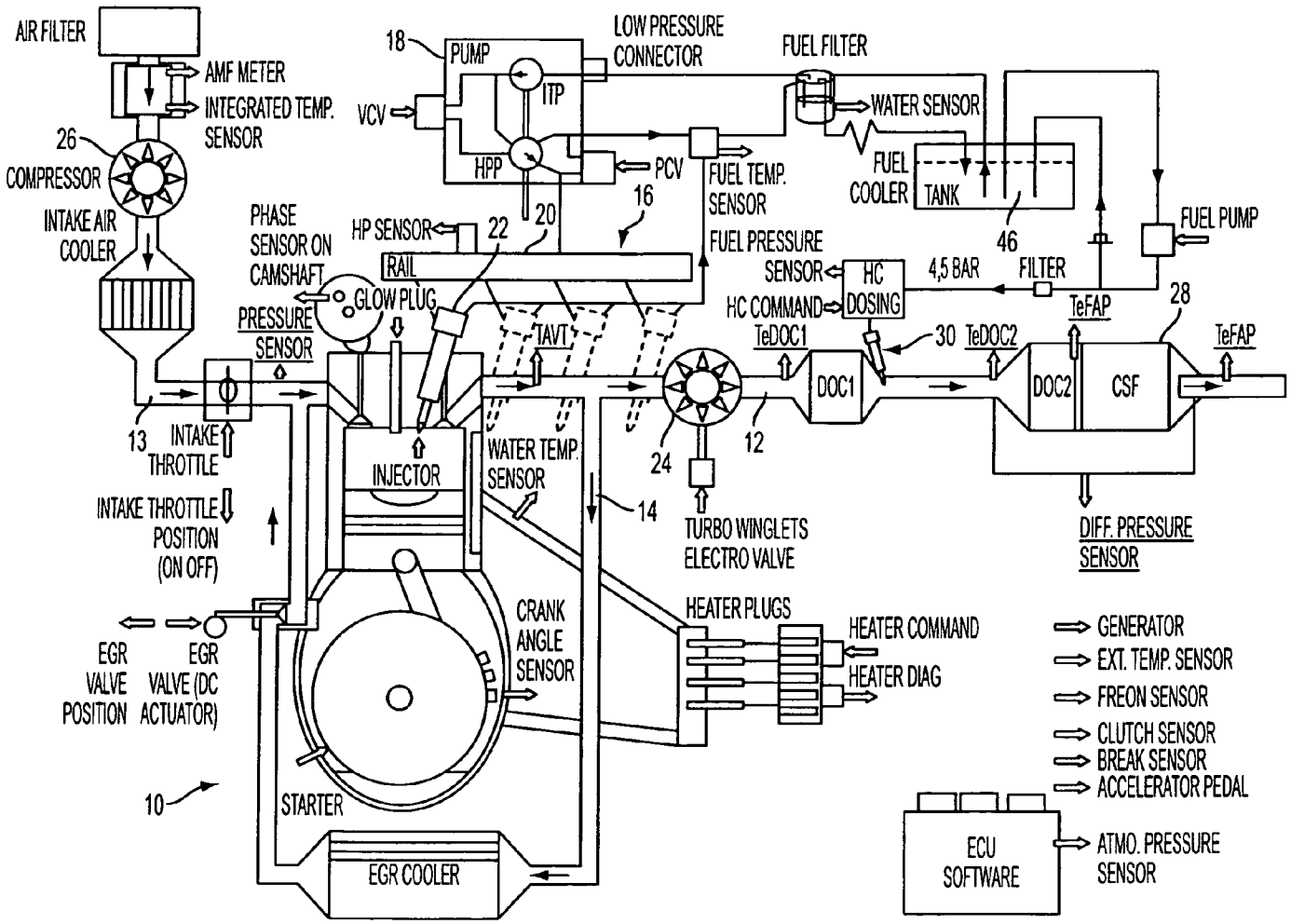
FIG. 1 is a schematic diagram of an exhaust gas purifying system including a water-cooled diesel dosing structure in accordance with an embodiment of the present invention.

Referring to FIG. 1 of the drawings, a multi-cylinder diesel engine, generally indicated at 10, for vehicles is provided with an exhaust passage 12 and intake passage 13. The intake passage 13 is distributes intake air to each cylinder. The exhaust passage 12 and the intake passage 13 are connected by an exhaust gas recirculation (EGR) passage 14 in the conventional manner.

The engine 10 is provided with a common rail fuel injection device, generally indicated at 16. The fuel injection device 16 is provided with a supply pump 18, common rail 20 and an injector 22 provided for every cylinder. Fuel pressurized by the supply pump 18 is distributed to each injector 22 via the common rail 20.

A variable capacity turbocharger 24 is provided in the exhaust passage 12 downstream of the EGR passage 14. Compressor 26, installed in the intake passage 13, can be considered to be part of the turbocharger 24. A turbine (not shown) of the turbocharger 24 transforms the energy of the flow of exhaust gas into rotational energy, and can drive the compressor 26 using this rotational energy.

A diesel particulate filter (DPF) 28 which traps particulate matter in the exhaust gas is installed in the exhaust passage 12 downstream of the turbine 24. Diesel fuel burns off the particulates trapped in the filter, thus regenerating particulate storage capacity.

Figure 2:
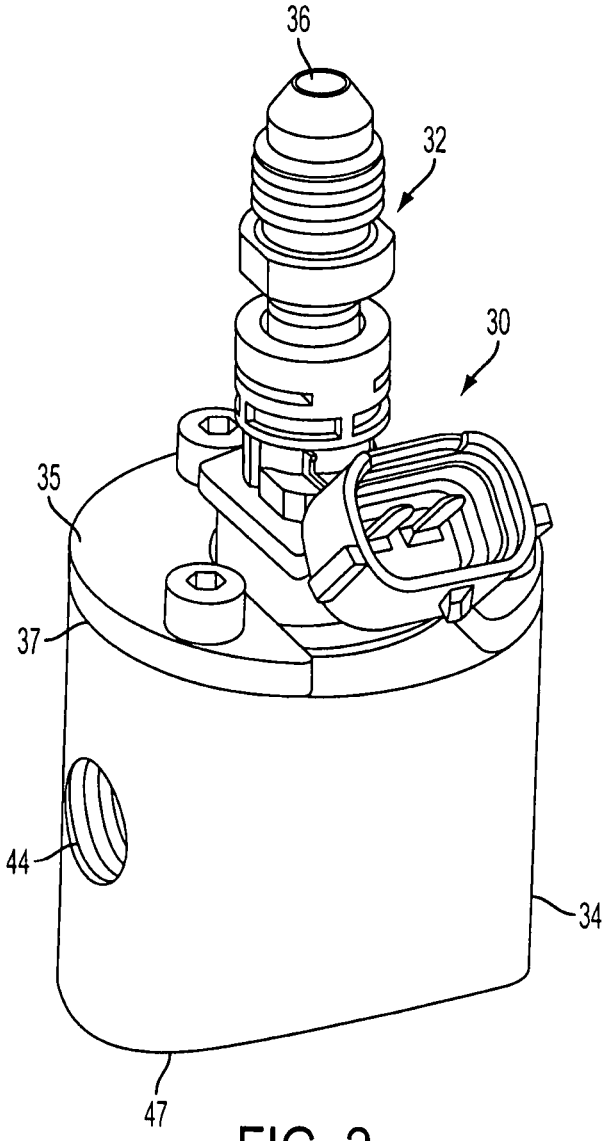
FIG. 2 is a view of the diesel dosing structure of FIG. 1.

As shown in FIG. 1, a diesel dosing structure, generally indicated at 30, is provided to inject fuel into the exhaust stream. More particularly, the dosing structure 30 is preferably provided in the exhaust passage 12 upstream or downstream of the turbocharger 24, and upstream of the filter 28. With reference to FIG. 2, the dosing structure 30 includes a dosing valve, generally indicated at 32, coupled to a water jacket 34.

Figure 3:
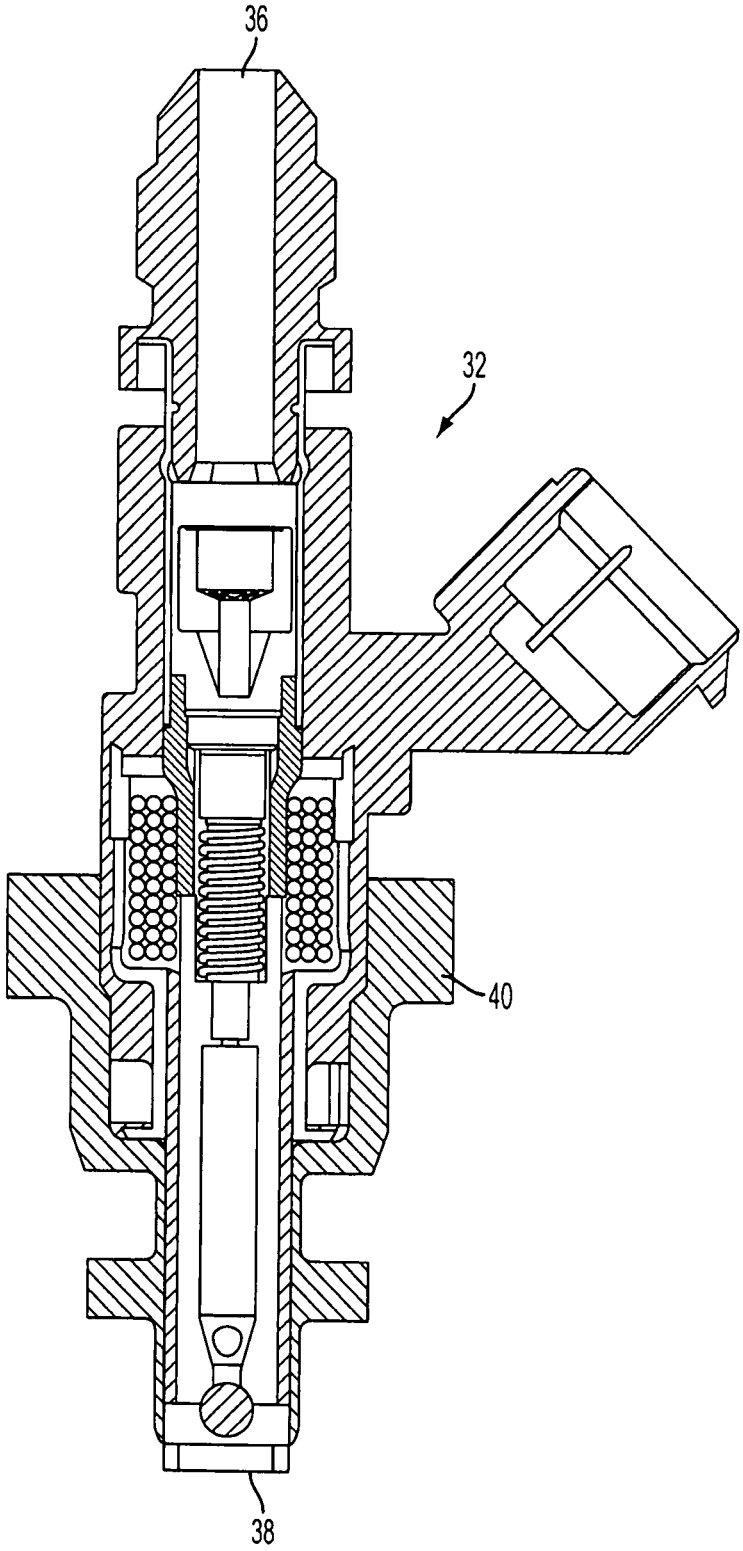
FIG. 3 is a view of the diesel dosing valve of the diesel dosing structure of FIG. 2.

As seen in FIG. 3, the dosing valve 32 is preferably a gasoline, electrically operated fuel injector without a precision orifice. Since there is no need for special spray patterns from the injector, a simple pencil stream is sufficient. A suitable injector can be of the type disclosed in U.S. Pat. No. 6,685,112, the content of which is hereby incorporated by reference into this specification. The dosing valve 32 has a fuel inlet 36 and a fuel outlet 38. The inlet 36 receives diesel fuel from the tank 46 (FIG. 1). The fuel outlet 38 is disposed so as to inject fuel into the exhaust passage 12, as will be explained more fully below. The dosing valve 32 is a laser welded configuration, thus there are no O-rings for diesel fuel sealing. More particularly, the dosing valve 32 has a laser welded seal for fuel supply and for fuel exhaust. In addition, the fuel path of the dosing valve 32 is of all stainless steel material. The dosing valve 32 includes a mounting and water sealing cup 40 that is mounted to the water jacket 34.

Figure 4:
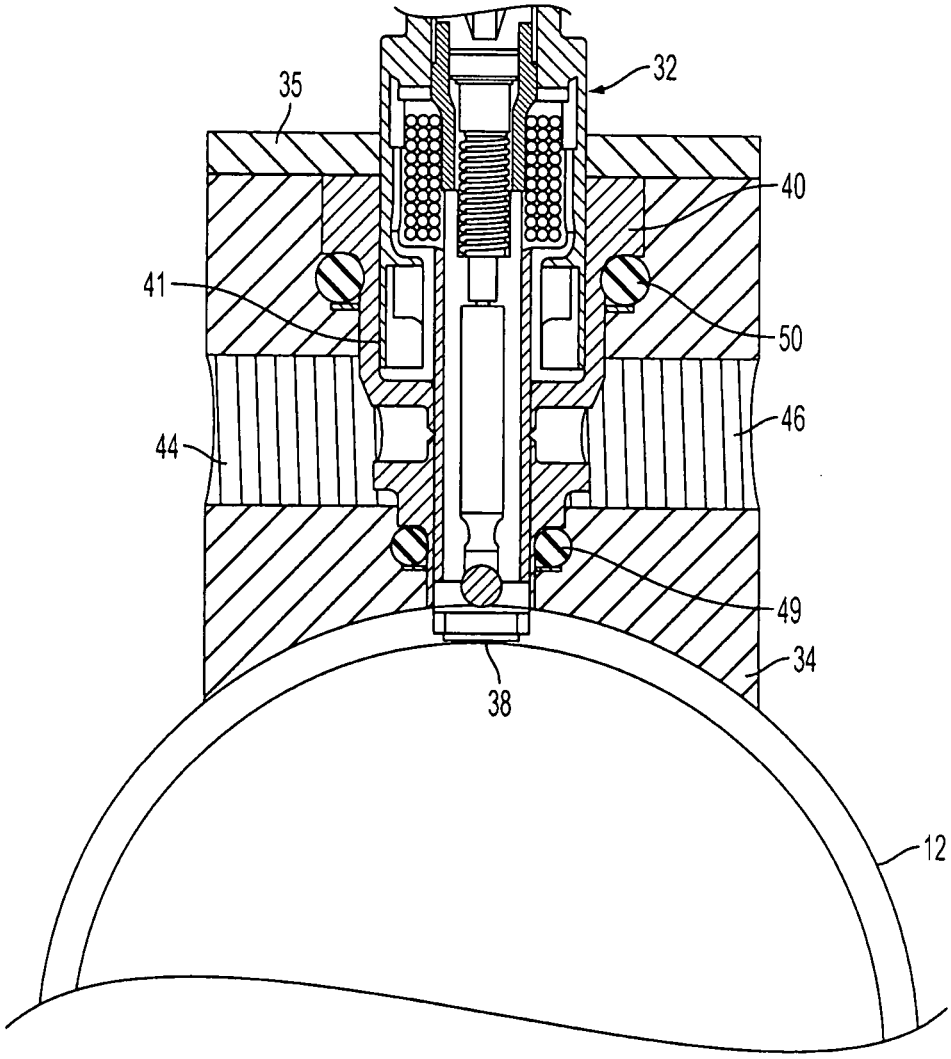
FIG. 4 is a partial sectional view of the diesel dosing structure of FIG. 2 mounted to an exhaust passage.

With reference to FIG. 4, the water jacket 35 includes a cover 35 at one end 37 having an opening 39 that receives a portion 41 of the dosing valve 32. The water jacket 34 is of generally cylindrical configuration having an inlet 44 and an outlet 46. The portion 41 of the dosing valve is disposed in the water jacket 34 between the inlet 44 and outlet 46 so as to be exposed to water in the water jacket 34 to directly cool the portion 41 of the dosing valve 32. The other end 47 of the water jacket 34 is welded to the exhaust passage 12. The fuel outlet 38 of the dosing valve 32 thus delivers fuel into the exhaust passage 12. O-rings 49 and 50 prevent water from leaking past the dosing valve 32.

Figure 5:
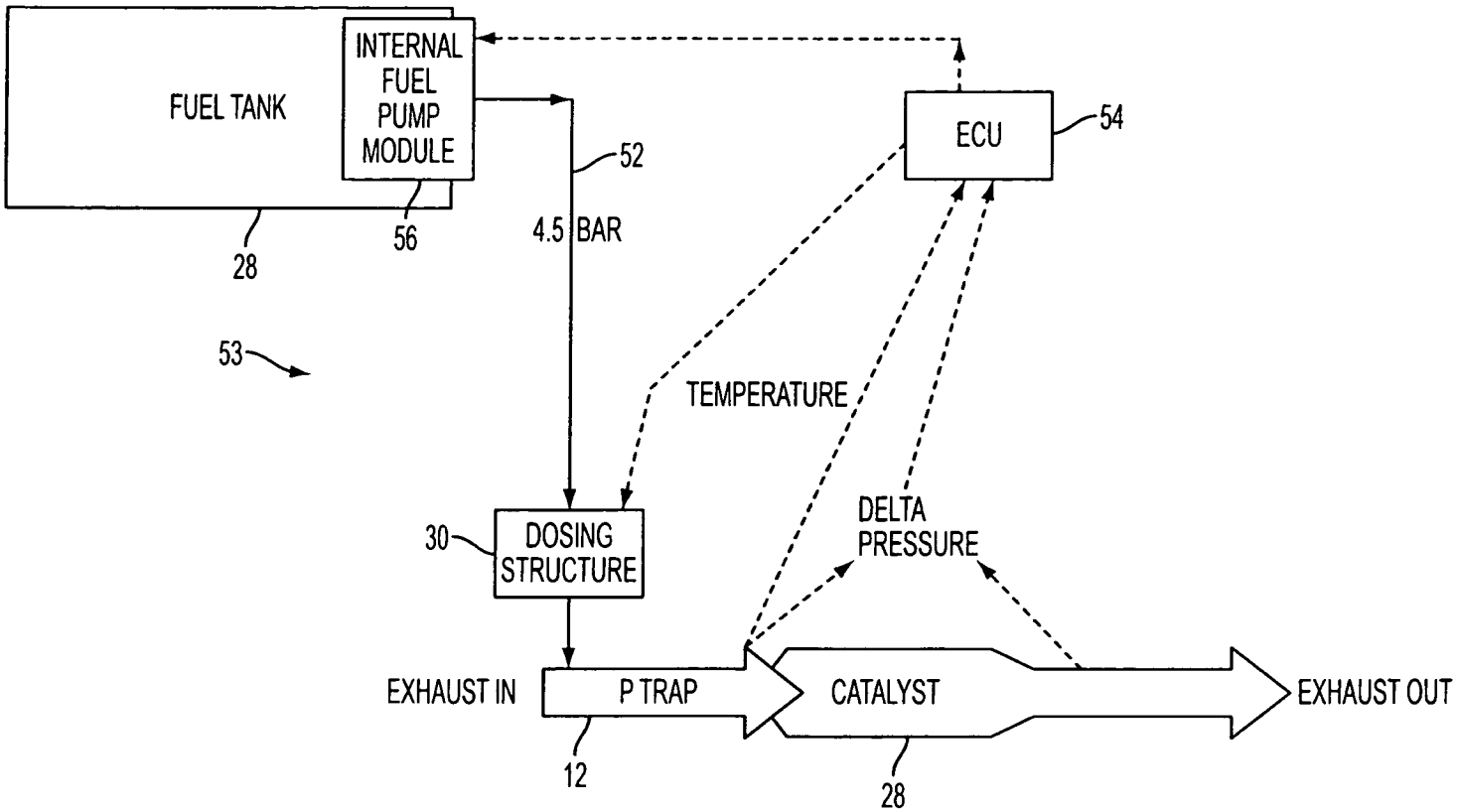
FIG. 5 is a block diagram of a dosing system including the dosing structure.

FIG. 5 shows a block diagram of a dosing system, generally indicated at 53, employing the dosing structure 30. Electrical connections are shown in dashed lines. Thus, an Electronic Control Unit (ECU) 54 can periodically control a fuel pump 56 to deliver diesel fuel from tank 28 to the dosing valve 32 of dosing structure 30. The ECU also controls the dosing valve 32 to send fuel into the exhaust line 12 to reduce particulates and possibly reduce NOx emissions. It can be appreciated that instead of the ECU 54 controlling the dosing valve 32, a separate controller can control the dosing valve 32.

The dosing structure 30 also reduces oil dilution. In addition, system cost is reduced since a smaller particulate trap can be used, the water cooled system provides direct water cooling of the dosing valve 32, and the structure 30 uses existing technologies.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. Structure for supplying fluid to an exhaust passage of a fuel system, the structure comprising:

a unitary electrically operated valve constructed and arranged to receive a supply of fluid and to deliver the fluid to the exhaust passage, a water jacket separate from the valve and having an inlet and an outlet on a common axis, with the inlet in fluid communication with the outlet, the water jacket surrounding at least a portion of the valve disposed between the inlet and the outlet so as to provide direct water-cooling of the valve, and at least one O-ring seal, between the water jacket and the valve, constructed and arranged to prevent water from leaking past the valve, wherein the valve is a gasoline-type fuel injector having a solenoid coil and a non-precision orifice, integral with the fuel injector, as an outlet disposed to inject a generally linear stream of the fluid directly into the exhaust passage, and wherein the portion of the valve that is surrounded by the water jacket is integral with and generally adjacent to the coil.

2. The structure of claim 1, in combination with a control unit electronically controlling operation of the fuel injector.

3. The structure of claim 1, wherein the water jacket includes a cover at one end thereof having an opening that receives the portion of the dosing valve.

4. The structure of claim 3, wherein another end of the water jacket is constructed and arranged to be coupled to the exhaust passage.

5. The structure of claim 3, in combination with the exhaust passage, wherein another end of the water jacket is welded to the exhaust passage.

6. The structure of claim 1, wherein the water jacket is generally cylindrical having an inlet and an outlet.

7. The structure of claim 6, wherein the portion of the dosing valve is disposed between the inlet and the outlet.

8. Dosing structure for supplying fluid to an exhaust passage of an engine, the dosing structure comprising:

a unitary electrically operated gasoline-type fuel injector having a solenoid coil and a non-precision orifice, integral with the fuel injector, as an outlet for delivering a generally linear stream of fluid directly to the exhaust passage, and means for water cooling the fuel injector, the means for water cooling being separate from the fuel injector and having an inlet and an outlet on a common axis, with the inlet in fluid communication with the outlet, the means for cooling surrounding at least a portion of the fuel injector disposed between the inlet and the outlet so as to provide direct water-cooling of the fuel injector, means, between the water jacket and the fuel injector, for preventing water from leaking past the fuel injector, wherein the portion of the fuel injector that is surrounded by the means for water cooling is integral with and generally adjacent to the coil.

9. The structure of claim 8, wherein the means for water cooling is a water jacket.

10. The structure of claim 8, in combination with a control unit electronically controlling operation of the fuel injector.

11. The structure of claim 9, wherein the means for delivering is an electrically controlled fuel injector and wherein the water jacket includes a cover at one end thereof having an opening that receives a portion of the fuel injector.

12. The structure of claim 11, wherein another end of the water jacket is constructed and arranged to be coupled to the exhaust passage.

13. The structure of claim 11, in combination with the exhaust passage, wherein another end of the water jacket is welded to the exhaust passage.

14. The structure of claim 11, wherein the water jacket is generally cylindrical having an inlet and an outlet.

15. The structure of claim 14, wherein the portion of the fuel injector is disposed between the inlet and the outlet.

16. A method of supplying diesel fuel to an exhaust passage of a diesel system to reduce particulates in the exhaust passage, the method including the steps of:

providing a unitary electrically controlled gasoline-type fuel injector having a solenoid coil and a non-precision orifice, integral with the fuel injector, as a dosing valve associated with an exhaust passage of a diesel system, operating the dosing valve to inject a generally linear stream of diesel fuel directly from the non-precision orifice of the fuel injector into the exhaust passage, providing a water jacket separate from the fuel injector and having an inlet and an outlet on a common axis, with the inlet in fluid communication with the outlet, the water jacket surrounding at least a portion of the fuel injector disposed between the inlet and the outlet, providing coolant flow from the inlet to the outlet of the water jacket to cool the fuel injector at the portion that is generally adjacent to the coil, and providing at least one O-ring seal, between the water jacket and the fuel injector, to prevent water from leaking past the fuel injector.

17. The method of claim 16, wherein the step of providing water cooling includes providing a water jacket, containing water, to surround at least a portion of the fuel injector.

18. The method of claim 17, wherein the water jacket is generally cylindrical with one end coupled to the exhaust passage.

19. The structure of claim 1, wherein the fluid is diesel fuel.

20. The structure of claim 8, wherein the fluid is diesel fuel.

* * * * *